United States Patent [19]

Ikeda et al.

[11] Patent Number: 4,839,332

[45] Date of Patent: Jun. 13, 1989

[54] HEAT-SENSITIVE RECORDING MATERIAL

[75] Inventors: Kensuke Ikeda; Naoto Yanagihara; Ken Iwakura, all of Shizuoka, Japan

[73] Assignee: Fuji Photo Film Co., Ltd., Kanagawa, Japan

[21] Appl. No.: 144,143

[22] Filed: Jan. 15, 1988

[30] Foreign Application Priority Data

Jan. 16, 1987 [JP] Japan ..... 62-7937
Jan. 19, 1987 [JP] Japan ..... 62-9541
Jan. 23, 1987 [JP] Japan ..... 62-13775

[51] Int. Cl.[4] ..... B41M 5/18

[52] U.S. Cl. ..... 503/212; 427/151; 428/913; 503/216; 503/217; 503/218; 503/220; 503/223; 503/226

[58] Field of Search ..... 427/150–152; 503/216, 217, 220, 223, 225, 212, 218; 428/913, 914, 195

[56] References Cited

U.S. PATENT DOCUMENTS 3,928,686 12/1975 Poot et al. ..... 430/616
4,211,436 7/1980 Kühlthau ..... 428/914

*Primary Examiner*—Bruce H. Hess
*Attorney, Agent, or Firm*—Sughrue, Mion, Zinn, Macpeak & Seas

[57] ABSTRACT

A heat-sensitive recording material is disclosed. The material is comprised of a support having thereon a heat-sensitive color forming layer comprising at least one electron-donating colorless dye and at least one electron-accepting compound, wherein the electron-donating colorless dye is a fluorene derivative having at least one substituted amino group and the electron-accepting compound has an acid group and a solubility in ethanol of 10 or less at 25° C.

The material exhibits improved color developability, improved preservability before recording, improved image stability, and improved chemical resistance.

13 Claims, No Drawings

HEAT-SENSITIVE RECORDING MATERIAL

FIELD OF THE INVENTION

This invention relates to a heat-sensitive recording material utilizing a color formation reaction between an electron-donating colorless dye and an electron-accepting compound, and more particularly to a heat-sensitive recording material having improved color developability and preservability and providing a color image having improved stability and chemical resistance.

BACKGROUND OF THE INVENTION

Recording materials using a combination of an electron-donating dye precursor (hereinafter referred to as color former) and an electron-accepting compound (hereinafter referred to as color developer) are well known as a pressure-sensitive paper, a heat-sensitive paper, a light- and pressure-sensitive paper, an electric heat-sensitive paper, and the like. Details of these recording materials are described, e.g., in British Patent No. 2,140,449, U.S. Pat. Nos. 4,480,052 and 4,436,920, Japanese Patent Publication No. 23922/85, and Japanese Patent Application (OPI) Nos. 179836/82, 123556/85, and 123557/85 (The term "OPI" as used herein means "unexamined published Japanese patent application").

These recording materials must (1) provide an image having sufficient color density with sufficient color formation sensitivity, (2) cause no fog, (3) provide an image having sufficient fastness, (4) form a hue suitable for copying machines, (5) have a high S/N ratio, (6) provide an image sufficiently resistant to chemicals, and the like. However, none of the conventional recording materials has completely fulfilled these requirements.

While, in particular, heat-sensitive recording materials have recently undergone a marked development, they still have disadvantages of fog generation due to contact with solvents, etc. and decoloration or discoloration of a recorded image due to contact with fats and oils, chemicals, fingers, etc. Specifically, if a heat-sensitive recording material comes into contact with stationery, such as aqueous or oily inks, fluorescent inks, stamp inks, adhesives, starch paste, diazo developers, etc., or cosmetics, such as hand creams, emulsions, etc., the white background tends to fog or the color developed area tends to discolor. Further, heat-sensitive materials recently enjoy an increasing demand as POS (Point-of-sales) labels. Accordingly, there is a great and growing demand in the market for chemically resistant heat-sensitive materials including heat-sensitive labels.

Furthermore, with the recent increase in use of bar codes, etc. which are read by means of a semiconductor laser, development of a recording material forming a color image having an absorption wavelength between 700 nm and 1000 nm is required.

Research into each of color formers and color developers in pursuit of a satisfactory recording material, with attention directed to solubility in oil or water, partition coefficient, pKa, polarity of substituents, position of substituents, change in crystallizability and solubility when used in combination, and the like has been conducted.

SUMMARY OF THE INVENTION

One object of this invention is to provide a heat-sensitive recording material which exhibits satisfactory color developability and preservability and provides a color image having satisfactory stability, chemical resistance, and an absorption wavelength in the near infrared region.

Another object of this invention is to provide a heat-sensitive recording label which exhibits satisfactory color developability and preservability and provides a color image having satisfactory stability, excellent chemical resistance, and other various performance characteristics.

It has now been found that the above objects are accomplished by a heat-sensitive recording material comprising a support having thereon a heat-sensitive color forming layer (recording layer) comprising at least one electron-donating colorless dye (color former) and at least one electron-accepting compound (color developer), wherein the electron-donating colorless dye is a fluorene derivative having at least one substituted amino group and the electron-accepting compound has an acid group and a solubility in ethanol of 10° or less at 25° C.

DETAILED DESCRIPTION OF THE INVENTION

The terminology "solubility in ethanol" as used herein means the weight (g) of solute that can be dissolved in 100 g of ethanol.

In the present invention, at least one compound used as a color developer should have the above-defined ethanol solubility of 10 or less, preferably 5 or less, more preferably 2 or less, and most preferably 1 or less, at 25° C. It is also preferable that the compound shows low-solubility in butyl acetate, toluene, acetone, ethyl acetate, or a like solvent.

The color developer according to the present invention also has low solubility in solvents widely employed in stationery, such as ethylene glycols (e.g., polyethylene glycol), amines (e.g., triethanolamine), and pyrrolidones.

The color developer according to the present invention includes organic compounds (having an acid group, e.g., a phenolic hydroxyl group, a mercapto group, a carboxyl group, a sulfo group, a sulfonamido group, an imido group, a ureido group, etc.,) and metal salts thereof. It is preferable for the color developer having an acid group, when converted to the zinc salt thereof, to have a solubility in ethanol of not more than 1.0, more preferably not more than 0.5, and most preferably not more than 0.1, at 25° C. The metal salts may be in the form of a complex with a specific organic ligand as hereinafter described.

The color developer according to the present invention preferably includes salicylic acid derivatives represented by formulae (I-a) to (I-c):

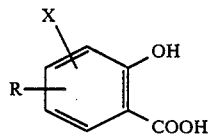

(I-a)

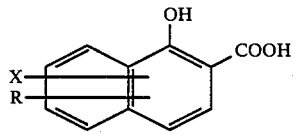

(I-b)

-continued

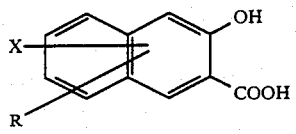

(I-c)

wherein R represents an alkyl group, an alkoxy group, an acyl group, an acylamino group or an aryl group; and X represents a hydrogen atom, an alkyl group, an alkoxy group, an aryl group or a halogen atom.

In formulae (I-a) to (I-c), the alkyl group as represented by R or X includes a substituted or unsubstituted and saturated or unsaturated alkyl or cycloalkyl group. The substituent for the alkyl group includes an aryl group, an alkoxy group, an aryloxy group, a halogen atom, an acylamino group, an aminocarbonyl group, a cyano group, etc. The aryl group as represented by R or X includes a substituted or unsubstituted phenyl group, a substituted or unsubstituted naphthyl group, and a substituted or unsubstituted aromatic heterocyclic group. The substituent for the aryl group includes an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

In formulae (I-a) to (I-c), R preferably represents an alkyl, alkoxy, acyl, or acylamino group having from 1 to 30 carbon atoms or an aryl group having from 6 to 24 carbon atoms, and X preferably represents a hydrogen atom, an alkyl group having from 1 to 9 carbon atoms, an alkoxy group having from 1 to 5 carbon atoms, a chlorine atom, or a fluorine atom.

These substituents as represented by R may have a substituent, e.g., an aryl group, an alkoxy group, a halogen atom, an aryloxy group, an acylamino group, a phenyl group, a substituted carbamoyl group, etc. Of the groups represented by R, preferred is an alkoxy group, the more preferred being an aryloxyalkoxy group represented by formula (I-d):

$$-O-C_mH_{2m}-O)_nAr \qquad \text{(I-d)}$$

wherein Ar represents a substituted or unsubstituted aryl group; m represents an integer of from 1 to 10, and preferably of from 2 to 4; and n represents an integer of from 1 to 3, and preferably 1 or 2.

The aryl group as represented by Ar may have one or more substituents, e.g., an alkyl group having from 1 to 12 carbon atoms, an aralkyl group having from 7 to 16 carbon atoms, an alkoxy group having from 1 to 12 carbon atoms, a halogen atom, a phenyl group, an alkoxycarbonyl group, etc., and preferably has 6 to 22 carbon atoms.

Specific examples of preferred aryl groups for Ar in formula (I-d) include a phenyl group, a tolyl group, an ethylphenyl group, a propylphenyl group, a butylphenyl group, a cyclohexyl group, an octylphenyl group, a nonylphenyl group, a dodecylphenyl group, a benzylphenyl group, a phenethylphenyl group, a cumylphenyl group, a xylyl group, a diphenethylphenyl group, a methoxyphenyl group, an ethoxyphenyl group, a benzyloxyphenyl group, an octyloxyphenyl group, a dodecyloxyphenyl group, a chlorophenyl group, a fluorophenyl group, a phenylphenyl group, a hexyloxycarbonylphenyl group, a benzyloxycarbonylphenyl group, a dodecyloxycarbonylphenyl group, a naphthyl group, a methylnaphthyl group, a chloronaphthyl group, and the like.

In formulae (I-a) to (I-c), the substituent represented by R is preferably positioned at the ortho-, metha- or para-position, and more preferably the paraposition, with respect to the COOH group.

The above-described salicyclic acid derivatives preferably contain 13 or more carbon atoms, and more preferably 16 or more carbon atoms, from the standpoint of water insolubility.

Specific examples of the color developer according to the present invention are 4-β-p-methoxyphenoxyethoxysalicylic acid, 4-β-p-ethoxyphenoxyethoxysalicylic acid, 4-β-p-benzyloxyphenoxyethoxysalicylic acid, 4-β-p-dodecyloxyphenoxyethoxysalicylic acid, 4-β-pchlorophenoxyethoxysalicylic acid, 4-β-p-phenylphenoxyethoxysalicylic acid, 4-β-p-cyclohexylphenoxyethoxysalicylic acid, 4-β-p-benzyloxycarbonylphenoxyethoxysalicylic acid, 4-β-p-dodecyloxycarbonylphenoxyethoxysalicylic acid, 4-β-naphthyl(2)oxyethoxysalicylic acid, 4- β-phenoxyethoxysalicylic acid, 4-(4-phenoxybutoxy)salicylic acid, 4-(6-phenoxyhexyloxy)salicylic acid, 4-(5-phenoxyamyloxy)salicylic acid, 4-(8-phenoxy-octyloxy)salicylic acid, 4-(10-phenoxydecyloxy)salicylic acid, 4-β- p-tolyloxyethoxysalicylic acid, 4-β-m-tolyloxyethoxysalicylic acid, 4-β-p-ethylphenoxyethoxysalicylic acid, 4-β-p-isopropylphenoxyethoxysalicylic acid, 4-β-p-t-butylphenoxyethoxysalicylic acid, 4-β-p-cyclohexylphenoxyethoxysalicylic acid, 4-β-p-benzylphenoxyethoxysalicylic acid, 4-β-o-methoxyphenoxyethoxysalicylic acid, 4-β-p-cumyloxyethoxysalicylic acid, 4-β-(2,6-dimethylphenoxy)ethoxysalicylic acid, 4-β-(3,5-dimethoxyphenoxy)ehtoxysalicylic acid, 4-β-(3,5-di-methylphenoxy)ethoxysalicylic acid, 5-β-p-ethylphenoxyethoxysalicylic acid, 4-β-phenoxyethoxy-6-methylsalicylic acid, 5-β-phenoyyethoxy-3-hydroxy-2-naphthoic acid, 7-β-phenoxyethoxy-3-hydroxy-2naphthoic acid, 7-dodecyloxy-3-hydroxy-2-naphthoic acid, 3-(2'-hydroxyphenyl)salicylic acid, 3-(2'-benzyloxyphenyl)-salicylic acid, 4-dodecyloxysalicylic acid, 4-tetradecyloxysalicylic acid, 4-pentadecyloxysalicylic acid, 4-hexadecyloxysalicylic acid, 4-octadecyloxysalicylic acid, 4-eicosyloxysalicylic acid, 4-triacontyloxysalicylic acid, 4-oleyloxysalicylic acid, 4-pentadecylsalicylic acid, 5-octadecylsalicylic acid, 5-stearoylsalicylic acid, 5-hexadecylsalicylic acid, 5-pentadecanoylsalicylic acid, 4-β-dodecyloxyethoxysalicylic acid, 4-(12-chlorododecyl)oxysalicylic acid, 4-β-N-stearoylaminoethoxysalicylic acid, 4-β-N-myristoylaminoethyxysalicylic acid, 4-β-perfluorohexylethoxysalicylic acid, 4-stearoylaminosalicylic acid, 4-p-phenylphenoxysalicylic acid, 4-p-N-myristoylcarbamoylphenyloxysalicylic acid, 4-p-dodecyloxyphenyloxysalicylic acid, 4-anilinocarbonylaminosalicylic acid, 3-cumyl-5-methylsalicylic acid, 3-cumyl-5-phenylsalicylic acid, 4β-phenethyloxysalicylic acid, 4-dodecyloxy-5-chlorosalicylic acid, 4-dodecyloxy-5-methylsalicylic acid, 4-dodecyloxy-6-methylsalicylic acid, 4-dodecyloxy-6-phenylsalicylic acid, 4-methoxy-6-dodecyloxysalicylic acid, 6-octadecyloxysalicylic acid, 4-p-t-octylphenyloxysalicylic acid, 4-benzyloxy-6-dodecyloxysalicylic acid, 4-β-p-t-octylphenoxyethoxysalicylic acid, 4-62 -p-nonylphenoxyethoxysalicylic acid, 4-β-p-dodecnylphenoxyethoxysalicylic acid, 4-(2-p-α-phenethylphenoxyethoxy)salicylic acid, 4-β(2,4-dimethylphenoxy)ethoxysalicylic acid, 4-β-(3,4-dimethylphenoxy)ethoxysalicylic acid, 4-β-(2,4-bit-α-phenethylphenoxy)ethoxysalicylic acid, 4-β-p-methoxyphenoxyethoxysalicylic acid, 4-β-p-ethoxyphenoxyethoxysalicylic acid, 4-β-phenoxyethoxy-6-chlorosalicylic acid, 4-β-phenoxyisopropyloxysalicylic acid, 4-ω-p-methoxyphenoxy-3-oxa-n-pentyloxysalicylic acid, 3-α-methylbenzyl-5-phenylsalicylic acid, 4-phenylacetylaminosalicylic acid, 4-stearoylaminosalicylic acid, 4-hexyloxysalicylic acid, 4-cyclohexyloxysalicylic acid, 4-octyloxysalicylic acid, 4-decyloxysalicylic acid, 4-p-chlorophenoxy-6-butylsalicylic acid, etc.

The above-described color developers may be used in the form of a salt of a metal selected from divalent or trivalent metals, e.g., zinc, magnesium, barium, calcium, aluminum, tin, titanium, nickel, cobalt, manganese, iron, etc., with a zinc salt and a magnesium salt being preferred. These color developers can be used either individually or in combinations thereof or with other color developers. The color developers which can be combined with those of the present invention preferably include compounds represented by formulae (II) to (IV):

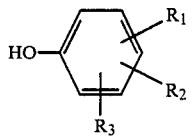

(II)

wherein $R_1$ and $R_2$, which may be the same or different, each represents a hydrogen atom, an alkyl group, an alkoxy group, an aryl group, an arylsulfonyl group, an alkoxycarbonyl group, or a halogen atom; and $R_3$ represents a hydrogen atom or a group represented by formula (V):

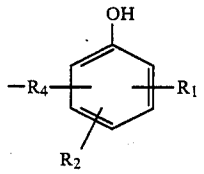

(V)

wherein $R_1$ and $R_2$ have the same meaning as $R_1$ and $R_2$ of formula (II); and $R_4$ represents a divalent group having from 1 to 12 carbon atoms, or $SO_2$;

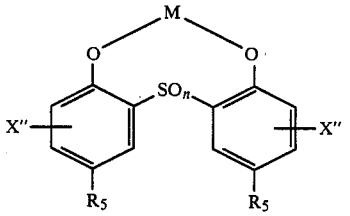

(III)

wherein $R_5$ represents a hydrogen atom, an aryl group, an alkyl group, or a halogen atom; X'' represents a hydrogen atom, an alkyl group, an alkoxy group, or a halogen atom; M represents a divalent metal element; and n represents 0, 1, or 2; and $$(R_6)_2Zn(A)_2 \quad \text{(IV)}$$

wherein $R_6$ represents a unidentate or multidentate, colorless organic ligand which is bonded to Zn via a hetero atom to form a complex; and A represents SCN, Cl, or a benzoate anion having an electron-attracting group.

Of the compounds represented by formula (II), preferred are those wherein $R_3$ is a hydrogen atom, and $R_1$ and $R_2$ each represents a hydrogen atom or an alkoxycarbonyl group; and those wherein $R_3$ is a group of formula (V), and $R_4$ represents an alkylene group having from 3 to 12 carbon atoms, a cycloalkylene group having from 5 to 7 carbon atoms, an aralkylene group having from 8 to 12 carbon atoms, or $SO_2$.

In formulae (II) and (V), the alkyl group includes saturated or unsaturated alkyl and cycloalkyl groups, which may be substituted with an aryl group, an alkoxy group, an aryloxy group, a halogen atom, a cyano group, etc.

Specific examples of compounds represented by formula (II) are 4-phenylphenol, bisphenolsulfone, p-phenylsulfponylphenol, p-tolylsulfonylphenol, bit(3-binyl4-hydroxyphenyl)sulfone, 2,2-bis(3-vinyl-4-hydroxyphenyl)propane, bis-3-allyl-4-hydroxyphenylsulfon, hexyl-4-hydroxybenzoate, 2,2'-dihydroxybiphenol, 2,2-bis(4-hydroxyphenyl)propane, 4,4'-isopyridenebis(2-methylphenol), 1,1-bis(3-chloro-4-hydroxyphenyl)cyclohexane, 1,1-bis(3-chloro-4-hydroxyphenyl)-2-ethylbutane, 4,4'-secisooctylidenediphenol, 4,4'-sec-butylidenediphenol, 4-p-methylphenylphenol, 4,4'-isopentylidenediphenol, 4,4'-methylcyclohexylidene-diphenol, 4,4'-dihydroxydiphenyl sulfide, 1,4-bis(4'-hydroxycumyl)benzene, 1,3-bis(4'-hydroxycumyl)benzene, 4,4'-thiobis(6-t-butyl-3-methylphenol), 4,4'-dihydroxy-diphenylsulfone, hydroquinone monobenzyl ether, 4-hydroxybenzophenone, 2,4-dihydroxybenzophenone, polyvinylbenzyloxycarbonylphenol, 2,4,4'- trihydroxybenzophenone, 2,2'4,4'-tetrahydroxybenzophenone, dimethyl 4-hydroxyphthalate, methy 4- hydroxybenzoate , 2,4,4'-trihydroxydiphenylsulfone, 1,5-bis-p-hydroxy-phenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methaxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cinnamyl orsellinate, o-chlorophenoxyethyl orsellinate, o-ethylphenoxyethyl orsellinate, o-phenylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, etc.

Specific examples of the compounds represented by formula (III) are zinc, nickel or magnesium salts of bis(2-hydroxy-5-butylphenyl)sulfone, bis(2-hydroxy-5-phenylphenyl)sulfone, bis(2-hydroxy-5-octylphenyl)sulfone, bis(2-hydroxy-5-chlorophenyl)sulfone, bis(2-hydroxy-3-chloro-5-butylphenyl)sulfone, etc.

In formula (IV), R6 preferably represents a pyridine, imidazole, quinoline, benzothiazole, benzimidazole, or antipyrine ligand, which may be substituted with an alkyl group, a cyano group, an alkoxy group, a phenyl group, an amino group, a formyl group, a vinyl group, etc.

Specific examples of the compounds represented by formula (IV) include imidazole complex, 2-phenylimidazole complex, picoline complex, pyridine complex, 2- benzylimidazole complex, benzimidazole complex, 2,3-dimethyl-1-phenyl-3-pyrazolin-5-one complex, 1-phenyl-2-methyl-3-benzyl-3-pyrazolin-5-one complex, 1-phenyl-2- methyl-3-(2-ethylhexyl)-3-pyrazolin-5-one complex, 1-phenyl-2-methyl-3-isopropyl-3-pyrazolin-5-one complex, 1-phenyl-2,3-dibenzylpyrazolin-5-one complex, or 1-phenyl-2-benzyl-3-methylpyrazolin-5-one complex of zinc rhodanide, etc.

The foregoing compounds represented by formulae (II) to (IV) may be used either individually or as combinations threreof.

It is preferable that the color developers to be used in the present invention are pulverized into fine particles having a particle size of not greater than about 3 μm, and more preferably not greater than 2 μm.

Use of a color developer having a specific range of ethanol solubility according to the present invention makes it possible to provide a heat-sensitive recording material which produces a color image having a sufficient density and marked stability, undergoing little discoloration even when exposed to light, heat, or humidity for a long time. Therefore, the color developer according to the present invention is particularly advantageous from the standpoint of long-term preservation of recorded information.

Moreover, the color developer of the invention does not give rise to unnecessary color formation on non-recorded areas or discoloration of a developed color image even on contact with fats and oils, chemicals, fingers, etc., exhibiting almost ideal performance properties for use in recording materials.

The amount of the color developer to be used preferably ranges from 50 to 800%, and more preferably from 100 to 500%, by weight based on the color former used.

In the present invention, fluorene derivatives having at least one substituted amino group are used as a color former.

The fluorene derivatives preferably include those represented by formula (VI):

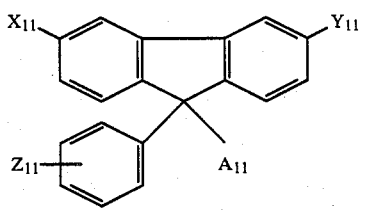

(VI)

wherein $X_{11}$ and $Y_{11}$, which may be the same or defferent, each represents an amine residual group; $Z_{11}$ represents a hydrogen atom or a substituted amino group; and $A_{11}$ represents a group necessary for forming a 5- or 6-membered heterocyclic ring containing at least one hetero atom, such as

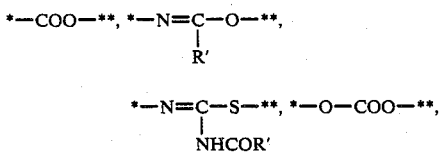

-continued

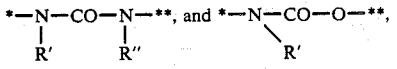

wherein a bond indicated by * denotes the position at which the group is connected to the benzene ring in formula (VI) and a bond indicated by ** denotes the position at which the group is connected to the fluorene ring in formula (VI), R' represents a hydrogen atom or an alkyl group, and R'' represents an alkyl group or an acyl group.

In formula (VI), the amine residual group represented by $X_{11}$, $Y_{11}$ or $Z_{11}$ is preferably a secondary amine residual group, and more preferably a secondary amine residual group having from 2 to 16 carbon atoms.

Illustrative examples of the secondary amine residual groups include a dimethylamino group, a diehtylamino group, a dipropylamino group, a dibutylamino group, an N-etnyl-N-isobutylamino group, an N-ethyl-N-isoamylamino group, an N-ethyl-N-cyclohexylamino group, a aiamylamino group, a dihexylamino group, a dioctylamino group, an N-etnyl-N-tetrahydrofurfurylamino group, etc.

Specific examples of the fluorene derivatives of formula (VI) are shown below:

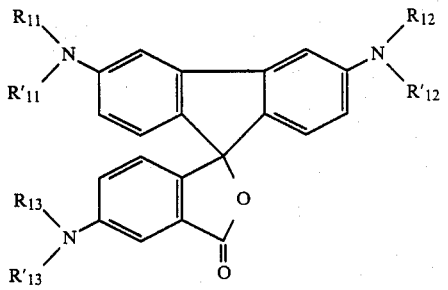

(1)

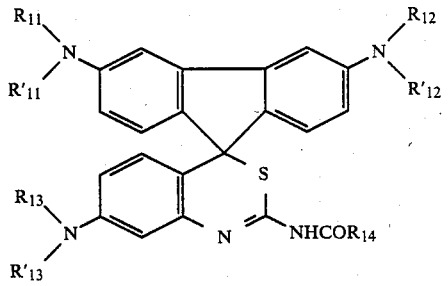

(2)

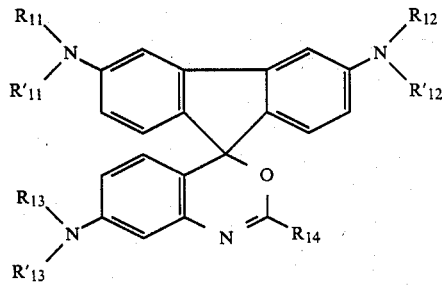

(3)

-continued (4)

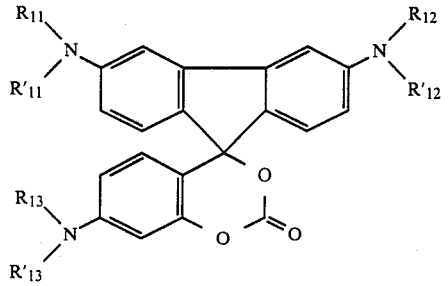

(5)

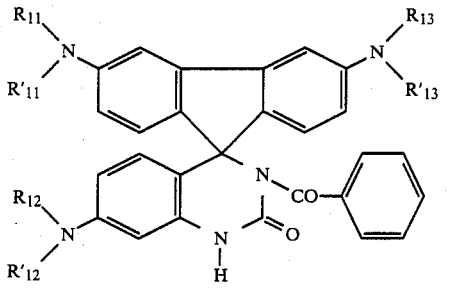

(6)

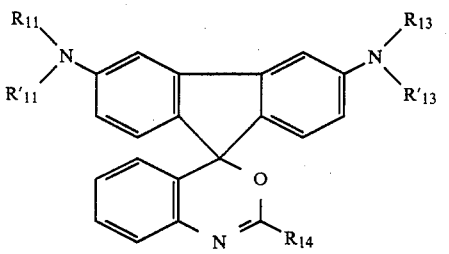

(7)

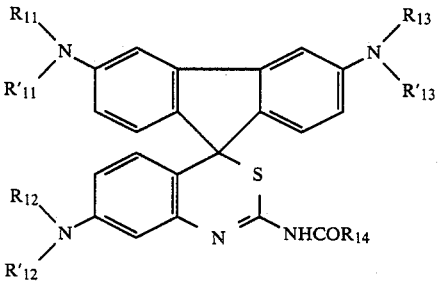

(8)

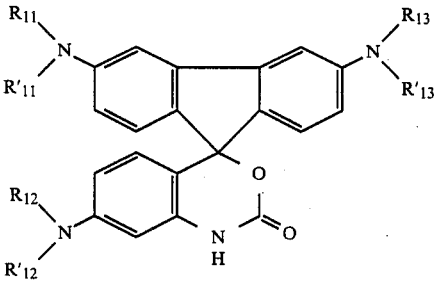

Wherein $R_{11}$, $R'_{11}$, $R_{12}$, $R'_{12}$, $R_{13}$, $R'_{13}$ and $R_{14}$, which may be the same or different, each represents a substituted or unsubstituted alkyl group having from 1 to 10 carbon atoms. The substituent for the alkyl group includes an aryl group, an alkoxy group, an aryloxy group, a halogen atom, a heterocyclic ring, etc.

These fluorene derivatives can be used either individually or as combinations of two or more thereof. Further, they may also be combined, if desired, with other known color formers, such as triarylmethanephthalide compounds, fluoran compouds, phenothiazine compounds, indolylphthalide compounds, xanthene compounds, leuco auramine compounds, diphenylmethane compounds, triazene compounds, spiropyran compounds, etc. When used in combination, these other color formers are preferably used in a total amount of from 0.1 to 0.5 part by weight per part by weight of the fluorene derivative of formula (VI) according to the present invention.

Specific examples of phthalide compounds are described, e.g., in U.S. Pat. No. Re. 23,024, and U.S. Pat. Nos. 3,491,111, 3,491,112, 3,491,116, and 3,509,174.

Specific examples of fluoran compounds are described, e.g., in U.S. Pat. Nos. 3,624,107, 3,627,787, 3,641,011, 3,462,828, 3,681,390, 3,920,510, and 3,959,571.

Specific examples of spiropyran compounds are described, e.g., in U.S. Pat. No. 3,971,808.

Specific examples of pyridine and pyrazine compounds are described, e.g., in U.S. Pat. Nos. 3,775,424, 3,853,869, and 4,246,318.

Illustrative examples of these color formers are given below. Triarylmethane phthalide compounds include 3,3-bis(p-dimethylaminophenyl)-6-dimethylaminophthalide (i.e., Crystal Violet Lactone), 3,3-bis(p-dimethylaminophenyl)phthalide, 3-(p-dimethylaminophenyl)-3-(1,3-dimethylindol-3-yl)phthalide, 3-(p-dimethylaminophenyl)-3-(2-methylindol-3-yl)phthalide, etc. Diphenylmethane compounds include 4,4'-bis-dimethylaminobenzhydrin benzyl ether, etc. Leuco auramine compounds include N-halophenyl-leucoauramine, N-2,4,5-trichlorophenylleucoauramine, etc. Xanthene compounds include RhodamineB anilinolactam, Rhodamine (p-nitroanilino)lactam, etc. Fluoran compounds include 2-(dibenzylamino)fluoran, 2-phenylamino-6-diethylaminofluoran, 2-(o-chloroanilino)-6diethylaminofluoran, 2-(3,4-dichloroanilino)-6-diethylaminofluoran, 2-anilino-3-methyl-6-piperidinofluoran, 2-phenyl-6-diethylaminofluoran, 3,6-bis(diphenylamino)fluoran, etc. Thiazine compounds include Benzyl Leuco Methylene Blue, p-nitrobenzyl Leuco Methylene Blue, etc. Spiropyran compounds include 3-methyl-spirodinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, 3-propyl-spiro-dibenzopyran, etc. These color formers may be used either individually or as combinations thereof.

Of these, preferred are triarylamethane compounds (e.g., Crystal Violet Lactone) and xanthene compounds, many of which cause less fog and provide high color densities.

Particularly preferred electon-donating colorless dyes to be combined with the fluorene derivative which can be used in the present invention are xanthene compounds represented by formula (VII):

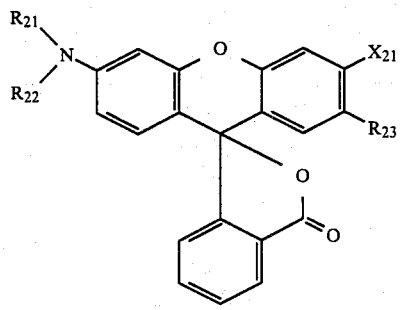

(VII)

wherein $R_{21}$ and $R_{22}$, which may be the same or different, each represents a substituted or unsubstituted aryl group having from 6 to 20 carbon atoms, a straight chain or branched or cyclic, substituted or unsubstituted, alkyl group having from 1 to 10 carbon atoms, or a 5- to 7membered heterocyclic ring; $R_{23}$ represents a hydrogen atom or an arylamino group, preferably an arylamino group having from 6 to 20 carbon atoms, and more preferably a substituted or unsubstituted anilino group (the substituent for the anilino group preferably includes an alkyl group having from 1 to 10 carbon atoms); and $X_{21}$ represents a hydrogen atom, a diarylamino group, an alkyl group having from 1 to 10 carbon atoms, an alkoxy group having from 1 to 10 carbon atoms, a phenyl group, or a halogen atom.

Specific but non-limiting examples of the xanthene compounds of formula (VII) are 2-anilino-3-methyl-6-dimethylaminofluoran, 2-anilino-3-methyl-6-N-methyl-N-ethylaminofluoran, 2-anilino-3-methyl-6-N-methyl-N-(isopropyl)aminofluoran, 2-anilino-3-methyl-6-N-methyl-N-pentylaminofluoran, 2-anilino-3-methyl-6-N-methyl-N-cyclohexylaminofluoran, 2-anilino-3-methyl-6-diethylaminofluoran, 2-anilino-3-chloro-6-dimethylamino-fluoran, 2-anilino-3-methyl-6-N-ethyl-N-isoamylamino-fluoran, 2-anilino-3-methyl-6-N-methyl-N-isoamylamino-fluoran, 2-anilino-3-chloro-6-diethylaminofluoran, 2-aniolino-3-chloro-6-N-methyl-N-ethylaminofluoran, 2-anilino-3-chloro-6-N-methyl-N-(isopropyl)aminofluoran, 2-anilino-3-chloro- 6-N-methyl-N-pentylaminofluoran, 2-anilino-3-chloro-6-N-methyl-N-cyclohexylaminofluoran, 2-anilino-3-methyl-6-N-ethyl-N-pentylaminofluoran, 2-anilino-3-chloro-6-N-ethyl-N-pentylaminofluoran, 2-(p-methylanilino)-3-methyl-6-dimethylaminofluoran, 2-(p-methylanilino)-3-methyl-6-diethylaminofluoran, 2-(p-methylanilino)-3-methyl-6-N-methyl-N-ethylaminofluoran, 2-(p-methylanilino)-3-methyl-6-N-methyl-N-(isopropyl)-aminofluoran, 2-(p-methylanilino)-3-methyl-6-N-methyl-N-pentylaminofluoran, 2-(p-methylanino)-3-methyl -6 -N-methy 1-N -cyclohexylaminofluoran, 2-(p-methylanilino)-3-methyl-6-N-ethyl-N-pentylaminofluoran, 2-(p-methylanilino)-3-chloro-6-dimethylaminofluoran, 2-(p-methylanilino)-3-chloro-6diethylaminofluoran, 2-(p-methylanilino)-3-chloro-6-N-methyl-N-ethylaminofluoran, 2-(p-methylanilino)-3-chloro-6-N-methyl-N-(isopropyl)aminofluoran, 2-(p-methylanilino)-3-chloro-6-N-methyl-N-cyclohexylaminofluoran, 2-(p-methylanilino)-3-chloro-6-N-methyl-N-pentylaminofluoran, 2-(p-methylanilino) -3-chloro-6-N-ethyl-N-pentylaminofluoran, 2-anilino-3methyl-6-N-methyl-N-furylmethylaminofluoran, 2-anilino-3-ethyl-6-N-methyl-N-furylmethylaminofluoran, 3,6-bisdiphenylaminofluoran, 2,2bis[4-[6'-(N-ethyl-N-isoamylamino)-3'-methylspiro(phthalido-3,9'-xanthene)-2'-ylamino]phenyl]propane, etc. These color formers may be used individually or, for the purpose of tone control or prevention of discoloration of a color image, as combinations of two or more thereof.

The color former to be used in the present invention is preferably used in an amount of from 0.1 to 1.0 g.

In the heat-sensitive recording material according to the present invention, the heat-sensitive color forming layer may contain, if desired, a heat-fusible substance in order to improve heat response performance.

The heat-fusible substance which can be used preferably includes compounds represented by the folowing formulae (VIII) to (XIII):

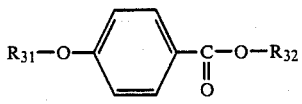

(VIII)

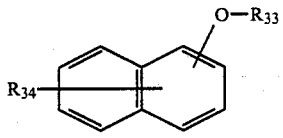

(IX)

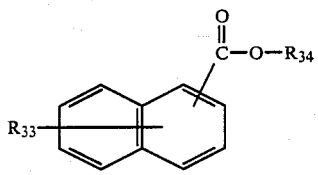

(X)

$R_{35}NHCONH_2$ (XI)

$R_{36}CONH—R_{37}$ (XII)

wherein $R_{31}$, $R_{32}$, $R_{33}$, and $R_{34}$, which may be the same or different, each represents a hydrogen atom, a phenyl group, a lower alkyl-substituted phenyl group, a halogen-substituted phenyl group, a benzyl group, a lower alkyl-substituted benzyl group, or a halogen-substituted benzyl group; $R_{35}$ and $R_{36}$, which may be the same or different, each represents an alkyl group having from 12 to 24 carbon atoms; and $R_{37}$ represents a hydrogen atom or a phenyl group; and

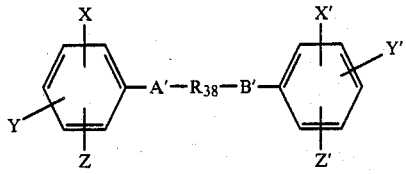

(XIII)

wherein $R_{38}$ represents a divalent group, preferably an alkylene group, an alkylene group having a carbonyl group, an alkylene group having a halogen atom, or an alkylene group having an unsaturated bond, and more preferably an alkylene group or an alkylene group having an ether linkage; X, Y, Z, X', Y', and Z', which may be the same or different, each represents a hydrogen atom, a halogen atom, an alkyloxycarbonyl group, or an aralkyloxycarbonyl group; and A' and B' each represents O or S.

In formulae (VIII) tO (XII), when $R_{31}$, $R_{32}$, $R_{33}$, or $R_{34}$ is a phenyl or benzyl group substituted with a lower alkyl group, the alkyl substituent has from 1 to 8 carbon atoms, and preferably from 1 to 3 carbon atoms. When it is substituted with a halogen atom, the halogen substituent is preferably a fluorine atom.

The compounds represented by formulae (VIII) to (XIII) preferably have a melting point ranging from 70° C. to 150° C., and more preferably from 80° C. to 130° C.

Specific examples of these compounds as the heat-fusible substance include benzyl p-benzyloxybenzoate, β-naphthyl benzyl ether, stearamide, palmitamide, N-phenylstearamide, N-stearlurea, phenyl β-naphthoate, phenyl 1-hydroxy-2-naphthoate, β-naphthol p-chlorobenzyl ether, β-naphthol p-methylbenzyl ether, α-naphthyl benzyl ether, 1,4-butanediol p-methylphenyl ether, 1,4-propanediol p-methylphenyl ether, 1,4-butanediol p-isopropylphenyl ether, 1,4-butanediol p-t-octylphenyl ether, 2-phenoxy-l-p-tolyloxy-ene, 1-phenoxy-2-(4-ethylphenoxy)ethane, 1-phenoxy-2-(4-chlorophenoxy)ethane, 1,4-butanediol phenyl ether, diethylene glycol bis(4-methoxyphenyl)ether, etc.

These heat-fusible substances may be used either individually or in combinations of two or more thereof. In order to achieve sufficient heat response performance, they are preferably used in an amount of from 10 to 200%, and more preferably from 20 to 150%, by weight based on the color developer.

The recording layer of the heat-sensitive recording material of this invention contains a water-soluble binder, and preferably a binder having a water-solubility of at least 5% by weight at 25° C. Specific examples of such a water-soluble binder include polyvinyl alcohol, methyl cellulose, carboxymethyl cellulose, hydroxyethyl cellulose, starches (including modified starch), gelatin, gum arabic, casein, a styrene-maleic anhydride copolymer hydrolysis product, an ethylene-maleic anhydride copolymer hydrolysis product, an isobutylene-maleic anhydride copolymer hydrolysis product, carboxylmodified polyvinyl alcohol, polyacrylamide, a saponification product of a vinyl acetate-acrylic acid copolymer, and the like. These binders may also be used as a dispersing agent for finely dispersing the color former, color developer, and heat-fusible substance.

If desired, the recording layer may further contain pigments, water-insoluble binders, metallic soaps, waxes, surface active agents, and the like.

The pigments which can be used include calcium carbonate, barium sulfate, lithopone, zinc oxide, calcined kaolin, synthetic pigments, talc, agalmatolite, kaolin, silica, amorphous silica, etc. Preferred of them are precipitated calcium carbonate, kaolin, surface treated amorphous silica, and aluminum hydroxide. In particular, when the aforesaid salicylic acid derivatives according to the present invention are used as a color developer, it is preferable to mix the salicylic acid derivatives with zinc compounds, e.g., zinc oxide, zinc carbonate, etc., as pigments and disperse the mixture in a binder.

The water-insoluble binders to be added generally include synthetic rubber latices and synthetic resin emulsions, e.g., a styrene-butadiene rubber latex, an acrylonitrile-butadiene rubber latex, a methyl acrylatebutadiene rubber latex, a vinyl acetate emulsion, etc. The amount of surface active agent to be added to the rubber latex or resin emulsion is preferably as small as possible from the standpoint of fog prevention. In other words, the so-called soap-free rubber latices or emulsions are preferred.

The metallic soaps to be used include higher fatty acid metal salts, e.g., emulsions of zinc stearate, calcium stearate, aluminum stearate, etc.

The waxes to be used include emulsions of paraffin wax, microcrystalline wax, carnauba wax, methylolstearamide, polyethylene wax, polystyrene wax, etc.

The surface active agents to be used include alkali metal salts of sulfosuccinic acid compounds and fluorine-containing surface active agents.

For the purpose of preventing color disappearance of a recorded image and improving fastness of the image, a discoloration inhibitor may be incorporated into the heat-sensitive color forming layer.

In the production of the heat-sensitive recording materials of the present invention, a coating composition comprising the aforesaid components is coated on a support, e.g., paper, a synthetic resin film, etc., using general coating techniques, such as bar coating, blade coating, air knife coating, gravure coating, roll coating, spray coating, dip coating, and the like, followed by drying to form a heat-sensitive color forming layer.

The recording layer usually has a dry coverage of from 1 to 20 g/m$^2$. In the case of a heat-sensitive recording label, the dry coverage of the recording layer preferably ranges from 1 to 10 g/m$^2$.

On the resulting recording layer is provided a protective layer mainly comprising a water-soluble high polymer layer which is selected arbitrarily from among water-soluble and film-forming high polymers. Water-soluble high polymers include anionic, nonionic, and amphoteric high polymers. The anionic high polymers may be either natural or synthetic and include those containing —COO$^{\ominus}$, —SO$_3^{\ominus}$, etc., groups such as natural high polymers, e.g., gum arabic, alginic acid, etc.; semisynthetic high polymers, e.g., carboxymethyl cellulose, phthalated gelatin, sulfated starch, sulfated cellulose, lignin sulfonic acid, etc.; and synthetic high polymers, e.g., a maleic anhydride-based copolymer or a hydrolysis product thereof, a (meth)acrylic acid-based polymer or copolymer, polyvinyl alcohol, carboxylmodified polyvinyl alcohol, etc. The nonionic high polymers include polyvinyl alcohol, hydroxyethylcellulose, methylcellulose, etc. The amphoteric high polymer include gelatin, etc.

Of these water-soluble high polymers, silanol-modified polyvinyl alcohol which exhibits satisfactory adhesion to styrene-maleic anhydride copolymer, etc., used in the heat-sensitive color forming layer as disclosed, e.g., in Japanese Patent Application (OPI) No. 193189/83, and colloidal silica, are preferably used individually or in combination.

The water-insoluble high polymers which can also be employed in the protective layer include a styrene butadiene rubber latex, an acrylonitrile-butadiene rubber latex, a methyl acrylate-butadiene rubber latex, a polyvinyl acetate emulsion, etc.

For the purpose of increasing the whiteness of non-recorded areas, the protective layer may contain a fluorescent brightening agent. For the purpose of improving heat-recording suitability, preventing the protective layer from sticking to a thermal head on heat-recording, or improving water resistance, the protective layer may further contain a pigment (e.g., zinc oxide, calcium carbonate, barium sulfate, titanium oxide, lithopone, talc, agalmatolite, kaolin, aluminum hydroxide, silica, amorphous silica, etc.), a metallic soap (e.g., emulsions of higher fatty acid metal salts, e.g., zinc stearate, calcium stearate, aluminum stearate, etc.), a wax (e.g., emulsions of paraffin wax, microcrystalline wax, carnauba wax, methylolstearamide, polyethylene wax, etc.), a crosslinking agent, fine powders (e.g., styrene beads, urea-melamine resin fine powders, etc.), and the like. These additives are preferably used in a total amount of from 0.2 to 7 g/m$^2$.

In particular, the pigment is preferably added in an amount from 0.5 to 4 times, and more preferably from 0.8 to 3.5 times, the total weight of the high polymers of the protective layer. With the amount of the pigment being less than the above lower limit, significant effects as above described cannot be produced. On the other hand, the pigment when added in an amount exceeding the above upper limit causes a serious reduction in heat sensitivity impairing the commercial value of the heat-sensitive recording material. The metallic soap is added in an amount of from 0.5 to 20% by weight, and preferably from 1 to 10% by weight, based on the total weight of the protective layer. The wax is added in an amount of from 1 to 20% by weight, and preferably from 1 to 10% by weight, based on the total weight of the protective layer.

In order to form a uniform protective layer, a surface active agent is added to a protective layer coating composition. Suitable surface active agents include alkali metal salts of sulfosuccinic acid compounds, fluorine-containing surface active agents, and the like, for example, a sodium or ammonium salt of di-(2-ethylhexyl)sulfosuccinic acid or di-(n-hexyl)sulfosuccinic acid. In general, an anionic surface active agent is effective.

The protective layer can be formed in the same manner as for the heat-sensitive recording layer. The dry coverage preferably ranges from about 0.5 to 10 g/m$^2$, and more preferably from 1 to 5 g/m$_2$.

The heat-sensitive recording material of this invention may further comprise a backing layer on the back side of a support for the purpose of curling correction, static charge prevention, and control of the coefficient of friction.

Where the present invention is applied to a heat-sensitive recording label, an adhesive layer for adhesion to other solid objects is further provided on the back side of the support, and a release backing paper is provided on the surface of the adhesive layer. If desired, the label may be printed on its surface by UV printing or flexographic printing.

The support which can be used in the present invention includes not only paper but any other supports generally employed in the art, such as various non-woven fabrics, plastic films, synthetic paper, metal foils, and composite sheets thereof. In view of preservation of the recording materials, it is advantageous to use, as a support, heat-extracted neutral paper having a pH of from 3 to 9 which has been sized with a neutral sizing agent, such as an alkyl ketene dimer as disclosed in Japanese Patent Application (OPI) No. 14281/80. In order to prevent penetration of a coating composition into paper and to improve contact between a thermal head and a heat-sensitive recording layer, it is advantageous to use paper having Stoöckigt sizing degree/basis weight (in gram per square meter) of $3\times10^{-3}$ or more and a Bekk smoothness of 90 seconds or more (cf. U.S. Pat. No. 4,416,939).

Additional examples of paper which can be used in the present invention to advantage include paper having an optical surface roughness of 8 μm or less and a thickness between 40 μm and 75 μm as disclosed in Japanese Patent Application (OPI) No. 136492/83; paper having a density of 0.9 g/cm$^2$ or less and an optical contact ratio of 15% or more as disclosed in Japanese Patent Application (OPI) No. 69091/83; paper obtained by beating a pulp to a C.S. freeness (according to JIS 8121) of 400 cc or more as disclosed in Japanese Patent Application (OPI) No. 69097/83; paper having been rendered resistant to penetration of a coating composition; paper prepared by a Yankee machine, whose glossy surface is coated to provide a recording layer having improved color density and improved resolving power as disclosed in Japanese Patent Application (OPI) No. 65695/83; paper having been subjected to corona discharge treatment to improve coating properties as disclosed in Japanese Patent Application (OPI) No. 35985/84; and the like.

The present invention is now illustrated in greater detail with reference to Examples and Comparative Examples, but it should be understood that the present invention is not deemed to be limited thereto. In these examples, all the percents and parts are by weight unless otherwise indicated.

EXAMPLES 1 AND 2 AND COMPARATIVE EXAMPLES 1 TO 3

Color developers used and their solubility in ethanol at 25° C. are shown in Table 1. Color formers, heat-fusible substances, and pigments used are shown in Table 2.

Twenty grams of each of the color former, color developer, and heat-fusible substance were poured into 100 g of a 5% aqueous solution of polyvinyl alcohol (PVA-105, prepared by Kuraray Co., Ltd.) with stirring. After thorough degassing, each of the mixtures was dispersed in a sand mill (Dynomill KDL, manufactured by WEB Company) to prepare a dispersion having a volume average particle size of not greater than 3 μm. Eighty grams of the pigment were dispersed in a homogenizer together with 160 g of a 0.5 % aqueous solution of sodium hexametaphosphate.

The resulting dispersions of each of the color former, color developer, heat-fusible substance, and pigment were mixed at a weight ratio of 1:2:2:8, and to the resulting mixture was added a 21% emulsion of zinc stearate in an amount equal to the dispersion of the color former.

The resulting coating composition was coated on fine paper having a basis weight of 50 g/m$^2$ with a wire bar to a dry coverage of 7 g/m$^2$ and dried in an oven at 50° C. to obtain a heat-sensitive recording material.

Each of the resulting heat-sensitive recording materials shown in Tables 1 and 2 below was evaluated in accordance with the following methods, and the results obtained are shown in Table 3 below.

(1) Heat Response Performance:

Test Chart No. 3 (Gazo Denshi gakki) was copied on the sample by the use of a high speed facsimile (UF-2, manufactured by Matsushita Electric Works, Ltd.), and the density of the developed color was determined by means of a Macbeth densitometer, RD-918.

(2) Preservability Under High temperature-High Humidity Conditions:

Both the samples before recording and the sample subjected to color formation by the method of (1) above were stored for 24 hours under a high temperature condition (60° C., 30% RH) or a high humidity condition (40° C., 90% RH), and the density of the white background after the storage (fog) was determined by means of RD-918.

(3) Chemical resistance:

Both the white background and the color-developed area were contacted with stationery, such as a fluorescent pen, a magic marker, etc., and the change was visually observed.

TABLE 1

| Example No. | Color Developer | Ethanol Solubility at 25° C. |
|---|---|---|
| Example 1 | 4-β-Phenoxyethoxysalicylic acid | 1 or less |
| Example 2 | 4-β-p-Methoxyphenoxyethoxy-salicylic acid | 1 or less |
| Comparative Example 1 | bisPhenol A | 100 or more |
| Comparative Example 2 | Benzyl p-hydroxybenzoate | 60 |
| Comparative Example 3 | 3,5-bis-α-Methylbenzyl-salicylic acid | 13 |

The resulting dispersions of each of the color former, color developer, heat-fusible substance, and pigment were mixed at a weight ratio of 1:2:2:8, and to the resulting mixture was added a 21% emulsion of zinc stearate in an amount equal to the dispersion of the color former.

The resulting coating composition was coated on fine paper having a basis weight of 50 g/m$^2$ with a wire bar to a dry coverage of 7 g/m$^2$ and dried in an oven at 50° C. to obtain a heat-sensitive color forming layer.

A heat-sensitive recording layer was formed in the same manner as in Example 1, except for coating a protective layer coating composition having the following formulation on the color forming layer with a coating bar to a dry weight of 3 g/m$^2$ and dried at 50° C. for 1 minute to obtain a heat-sensitive recording material.

TABLE 2

| Example No. | Color Former | Heat-Fusible Substance | Pigment |
|---|---|---|---|
| Example 1 | 3,6-bis(Dimethylamino)fluoren-9-spiro-3'-(6'-dimethylaminophthalide) | 2-Benzyloxy naphthalene | 1:1 (by weight) mixture of $CaCO_3$ and ZnO |
| Example 2 | 3,6-bis(Dimethylamino)fluoren-9-spiro-3'-(6'-dimethylaminophthalide) | Stearamide | 1:1 (by weight) mixture of $CaCO_3$ and ZnO |
| Comparative Example 1 | 3,6-bis(Dimethylamino)fluoren-9-spiro-3'-(6'-dimethylaminophthalide) | 2-Benzyloxy naphthalene | 1:1 (by weight) mixture of $CaCO_3$ and ZnO |
| Comparative Example 2 | 3,6-bis(Dimethylamino)fluoren-9-spiro-3'-(6'-dimethylaminophthalide) | 2-Benzyloxy naphthalene | 1:1 (by weight) mixture of $CaCO_3$ and ZnO |
| Comparative Example 3 | 3,6-bis(Dimethylamino)fluoren-9-spiro-3'-(6'-dimethylaminophthalide) | 2-Benzyloxy naphthalene | 1:1 (by weight) mixture of $CaCO_3$ and ZnO |

TABLE 3

| Example No. | Color Density | Background Fog | Background Fog After Preservation 60° C., 30% RH | Background Fog After Preservation 40° C., 90% RH | Fog on Contact With Stationery Fluorescent Pen | Absorption of Developed Color |
|---|---|---|---|---|---|---|
| Example | | | | | | |
| 1 | 0.93 | 0.06 | 0.10 | 0.07 | None | Observed |
| 2 | 0.92 | 0.05 | 0.06 | 0.05 | None | " |
| Comparative Example | | | | | | |
| 1 | 0.98 | 0.32 | 0.85 | 0.45 | Observed | " |
| 2 | 0.99 | 0.27 | 0.90 | 0.38 | " | " |
| 3 | 0.93 | 0.35 | 0.93 | 0.57 | " | " |

It can be seen from the results in Table 3 that the heat-sensitive recording materials using the color formers and color developers of the present invention exhibit markedly superior chemical resistance.

EXAMPLES 3 AND 4 AND COMPARATIVE EXAMPLES 4 AND 5

Color developers used and their solubility in ethanol at 25° C. are shown in Table 4. Color formers, heat-fusible substances, and pigments used are shown in Table 5.

Twenty grams of each of the color former, color developer, and heat-fusible substance were poured into 100 g of a 5% aqueous solution of polyvinyl alcohol (PVA-105, prepared by Kuraray Co., Ltd.) with stirring. After thorough degassing, each of the mixtures was dispersed in a sand mill (Dynomill KDL, manufactured by WEB Company) to prepare a dispersion having a volume average particle size of not greater than 3 μm. Eighty grams of the pigment were dispersed in a homogenizer together with 160 g of a 0.5% aqueous solution of sodium hexametaphosphate.

Protective Layer Formulation:

| | |
|---|---|
| 10% Silanol-modified polyvinyl alcohol (R-2105, produced by Kuraray Co., Ltd.) | 50 parts |
| Water | 50 parts |
| 30% Colloidal silica (Snow Latex, produced by Nissan Chemical Ind., Ltd. | 20 parts |
| 40% Kaolin dispersion | 10 parts |
| 50% Kayaphor (fluorescent brightening agent, produced by Nippon Kayaku Co., Ltd.) | 1.0 parts |

Each of the resulting heat-sensitive recording materials shown in Tables 4 and 5 below was evaluated in the same manner as in Example 1 and the results obtained are shown in Table 6 below.

TABLE 4

| Example No. | Color Developer | Ethanol Solubility at 25° C. |
|---|---|---|
| Example 3 | 4-β-Phenoxyethoxysalicyclic acid | 1 or less |
| Example 4 | 4-β-p-Methoxyphenoxyethoxy-salicylic acid | 1 or less |
| Comparative | bisPhenol A | 100 or more |

TABLE 4-continued

| Example No. | Color Developer | Ethanol Solubility at 25° C. |
|---|---|---|
| Example 4 | | |
| Comparative Example 5 | 3,5-bis-α-Methylbenzyl-salicylic acid | 13 |

TABLE 5

| Example No. | Color Former | Heat-Fusible Substance | Pigment |
|---|---|---|---|
| Example 3 | 2:3 (by weight) mixture of 3',6'-bis-Diethylamino-6-diethylaminospiro(isobenzofuran-1,9'-fluoren)-3-one and 2-Anilino-3-methyl-6-N—ethyl-N—isoamylaminofluorane | 2-Benzyloxynaphthalene | 1:1 (by weight) mixture of $CaCO_3$ and ZnO |
| Example 4 | 2:3 (by weight) mixture of 3',6'-bis-Diethylamino-6-diethylaminospiro(isobenzofuran-1,9'-fluoren)-3-one and 2-Anilino-3-methyl-6-N—ethyl-N—isoamylaminofluorane | Stearamide mixture of | 1:1 (by weight) $CaCO_3$ and ZnO |
| Comparative Example 4 | 2:3 (by weight) mixture of 3',6'-bis-Diethylamino-6-diethylaminospiro(isobenzofuran-1,9'-fluoren)-3-one and 2-Anilino-3-methyl-6-N—ethyl-N—isoamylaminofluorane | 2-Benzyloxy naphthalene | 1:1 (by weight) mixture of $CaCO_3$ and ZnO |
| Comparative Example 5 | 2:3 (by weight) mixture of 3',6'-bis-Diethylamino-6-diethylaminospiro(isobenzofuran-1,9'-fluoren)-3-one and 2-Anilino-3-methyl-6-N—ethyl-N—isoamylaminofluorane | 2-Benzyloxy naphthalene | 1:1 (by weight) mixture of $CaCO_3$ and ZnO |

TABLE 6

| Example No. | Color Density | Background Fog | Background Fog After Preservation 60° C., 30% RH | Background Fog After Preservation 40° C., 90% RH | Fog on Contact with Stationery: Fluorescent Pen | Fog on Contact with Stationery: Magic Marker |
|---|---|---|---|---|---|---|
| Example | | | | | | |
| 3 | 1.18 | 0.05 | 0.06 | 0.05 | None | None |
| 4 | 1.17 | 0.05 | 0.06 | 0.05 | None | None |
| Comparative Example | | | | | | |
| 4 | 1.19 | 0.06 | 0.07 | 0.09 | Serious | Serious |
| 5 | 1.18 | 0.08 | 0.09 | 0.13 | Serious | Serious |

It can be seen from the results in Table 6 that the heat-sensitive recording materials using the color formers and color developers of the present invention exhibit markedly superior chemical resistance.

EXAMPLE 5 AND COMPARATIVE EXAMPLES 6 TO 8

A heat-sensitive recording layer was formed on a support in the same manner as in Example 1, except for using each of the color formers, color developers, heat-fusible substances, and pigments shown in Tables 7 and 8 below.

A protective layer was formed on the heat-sensitive recording layer in the same manner as in Example 3, except for using a coating composition having the following formulation.

| Protective Layer Formulation: | |
|---|---|
| PVA R-2105 | 1 part |
| Kaolin (Georgia Kaobright) | 0.5 part |
| Colloidal silica (Snowdex S, produced by Nissan Chemicals Ind., Ltd.) | 1.2 parts |
| Zinc stearate emulsion (Hidrin Z-7, produced by Chukyo Yushi Co., Ltd.) | 0.1 part |
| Paraffin wax (Cellosol 428, produced by Chukyo Yushi Co., Ltd.) | 0.1 part |

A mixed solution having the following formulation was coated on the back side of the support with a wire bar to a dry weight of 3 g/m$^2$ and dried in an oven at 50° C. to form a backing layer.

| Backing Layer Formulation: | |
|---|---|
| Styrene-maleic anhydride copolymer (Polymalon 385, produced by Arakawa Kagaku Co., Ltd.) | 1 part |
| Kaolin (Georgia Kaobright) | 0.5 part |

A release paper having an adhesive layer was further provided on the back side of the support to produce a heat-sensitive recording label.

Heat-recording was conducted on each of the resulting labels with a thermal stamp at 120° C. for 1 second, and the density of a Macbeth densitometer, the developed color was determined by means of a Macbeth densitometer, RD-918.

Further, the heat-recorded surface and a filter paper impregnated with each of ethanol, castor oil, ethanolamine, 2-pyrrolidone, and toluene were overlapped therewith for 5 minutes under a load of 100 g/10 cm$^2$ by placing a glass plate thereon.

The fog on the white background and the degree of color disappearance (decoloration) on the color-developed area were rated as follows, A—very excellent
B—excellent
C—practically acceptable
D—unacceptable
E—seriously unacceptable and the results obtained are shown in Table 9 below.

TABLE 7

| Example No. | Color Developer | Ethanol Solubility at 25° C. |
|---|---|---|
| Example 5 | 4-β-p-Methoxyphenoxyethoxy-salicylic acid | 1 or less |
| Comparative Example 6 | bisPhenol A | 100 or more |
| Comparative Example 7 | Benzyl p-hydroxybenzoate | 60 |
| Comparative Example 8 | 3,5-bis-α-Methylbenzyl-salicylic acid | 13 |

TABLE 8

| Example No. | Color Former | Heat-Fusible Substance | Pigment |
|---|---|---|---|
| Example 5 | 2:3 (by weight) mixture of 2-Anilino-3-chloro-6-diethylamino-fluoran and 3',6'-bisDiethylamino-5-diethylaminospiro(isobenzofuran-1.9'-fluoren)-3-one | β-Benzyloxy-naphthalene | 1:1 (by weight) mixture of $CaCO_3$ and ZnO |
| Comparative Example 6 | 1:1 (by weight)mixture of 2-Anilino-3-chloro-6-diethylamino-fluoran and 2-Anilino-3-methyl-6-N—ethyl-N—isoamylaminofluoran | β-Benzyloxy-naphthalene | 1:1 (by weight) mixture of $CaCO_3$ and ZnO |
| Comparative Example 7 | 1:1 (by weight)mixture of 2-Anilino-3-chloro-6-diethylamino-fluoran and 2-Anilino-3-methyl-6-N—ethyl-N—isoamylaminofluoran | β-Benzyloxy-naphthalene | 1:1 (by weight) mixture of $CaCO_3$ and ZnO |
| Comparative Example 8 | 1:1 (by weight)mixture of 2-Anilino-3-chloro-6-diethylamino-fluoran and 2-Anilino-3-methyl-6-N—ethyl-N—isoamylaminofluoran | β-Benzyloxy-naphthalene | 1:1 (by weight) mixture of $CaCO_3$ and ZnO |

TABLE 9

| Example No. | Color Density | Ethanol | | Castor Oil | | Ethanolamine | | 2-Pyrrolidone | | Toluene | |
|---|---|---|---|---|---|---|---|---|---|---|---|
| | | Fog | Decoloration | Fog | Decoloration | Fog | Decoloration | Fog | Decoloration | Fog | Decoloration |
| Example 5 | 1.13 | A | A | A | B | A | B | A | B | B | B |
| Comparative Example 6 | 1.10 | D | E | B | D | B | D | B | D | D | E |
| Comparative Example 7 | 1.18 | D | E | B | D | B | D | B | D | D | E |
| Comparative Example 8 | 1.10 | D | E | C | C | B | D | B | D | D | E |

It can be seen from the results in Table 9 that the heat-sensitive recording labels using the color formers and color developers according to the present invention have markedly superior chemical resistance.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having thereon a heat-sensitive color forming layer comprising at least one electron-donating colorless dye and at least on electron-accepting compound, wherein said electron-donating colorless dye is a fluorene derivative having at least one substituted amino group and said electron-accepting compound has an acid group and a solubility in ethanol of 10 or less at 25° C.

2. A heat-sensitive recording material as claimed in claim 1, wherein said electron-accepting compound has a solubility in ethanol of 5 or less at 25° C.

3. A heat-sensitive recording material as claimed in claim 1, wherein said electron-accepting compound has a solubility in ethanol of 2 or less at 25° C.

4. A heat-sensitive recording material as claimed in claim 1, wherein the recording material further comprises a protective layer on the color forming layer.

5. A heat-sensitive recording material as claimed in claim 4, wherein the recording material further comprises an adhesive layer on the back side of the support.

6. A heat-sensitive recording material as claimed in claim 1, wherein said electron-accepting compound is selected from the group consisting of salicylic acid derivatives represented by formulae (I-a) to (I-c):

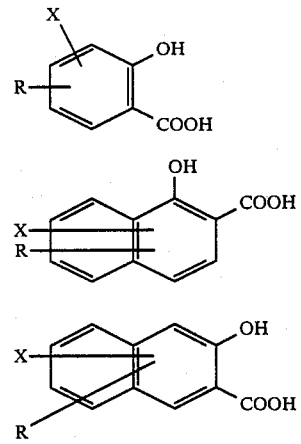

(I-a)

(I-b)

(I-c)

wherein R represents a substituted or unsubstituted alkyl group, a substituted or unsubstituted alkoxy group, a substituted or unsubstituted acyl group, a substituted or unsubstituted acylamino group or a substituted or unsubstituted aryl group; and X represents a hydrogen atom, a substituted or unsubstituted alkyl group, a substituted or unsubstituted alkoxy group, a substituted or unsubstituted aryl group or a halogen atom; and metal salts thereof.

7. A heat-sensitive recording material as claimed in claim 6, wherein the metal salts are zinc salts or magnesium salts.

8. A heat-sensitive recording material as claimed in claim 6, wherein R is an aryloxyalkoxy group represented by formula (I-d):

$$-O-(C_mH_{2m}-O)_n-Ar \qquad \text{(I-d)}$$

wherein Ar represents a substituted or unsubstituted aryl group, m represents an integer of from 1 to 10, and n represents an integer of from 1 to 3.

9. A heat-sensitive recording material as claimed in claim 6, wherein R is positioned at the paraposition with respect to the COOH group.

10. A heat-sensitive recording material as claimed in claim 6, wherein said salicylic acid derivatives contain 13 or more carbon atoms.

11. A heat-sensitive recording material as claimed in claim 1, wherein said fluorene derivative is represented y formula (VI):

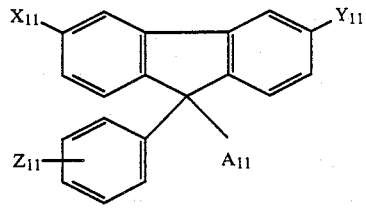

(VI)

wherein $X_{11}$ and $Y_{11}$, which may be the same or deffer-ent, each represents an amine residual group; $Z_{11}$ represents a hydrogen atom Or a substituted amino group; and $A_{11}$ represents a group necessary for forming a 5- or 6-membered heterocyclic ring containing at least one hetero atom.

12. A heat-sensitive recording material as claimed in claim 11, wherein $A_{11}$ represents $$*-COO-**,\ *-N=\underset{\underset{R'}{|}}{C}-O-**,\ *-N=\underset{\underset{NHCOR'}{|}}{C}-S-**,$$

$$*-O-COO-**,\ *-\underset{\underset{R'}{|}}{N}-CO-\underset{\underset{R''}{|}}{N}-**,\ \text{or}\ *-N(R')-CO-O-**$$

wherein a bond indicated by * denotes the position at which the group is connected to the benzene ring in formula (VI) and a bond indicated by ** denotes the position at which the group is connected to the fluorene ring in formula (VI), R′ represents a hydrogen atom or an alkyl group, and R″ represents an alkyl group or an acyl group.

13. A heat-sensitive recording material as claimed in claim 11, wherein the amine residual group as represented $X_{11}$, $Y_{11}$, or $Z_{11}$ is a secondary amine residual group having from 2 to 16 carbon atoms.

* * * * *